United States Patent [19]

Allison

[11] Patent Number: 5,060,434

[45] Date of Patent: Oct. 29, 1991

[54] DEMOUNTABLE WALL SYSTEM

[76] Inventor: Ronald J. Allison, 6550 Longpoint, Suite 204, Houston, Tex. 77055

[21] Appl. No.: 565,184

[22] Filed: Aug. 8, 1990

Related U.S. Application Data

[63] Continuation of Ser. No. 433,971, Nov. 9, 1989, abandoned.

[51] Int. Cl.[5] ..... E04H 1/00

[52] U.S. Cl. ..... 52/238.1; 52/241; 52/481; 52/489; 52/356; 52/511; 52/741

[58] Field of Search ..... 52/238.1, 241, 481, 52/489, 356–358, 509, 511, 741, 745

[56] References Cited

U.S. PATENT DOCUMENTS

| | | | |
|---|---|---|---|
| D. 249,965 | 10/1978 | Cooper . | |
| 1,810,597 | 6/1931 | Corwin . | |
| 1,814,202 | 7/1931 | Winget | 52/356 X |
| 1,876,528 | 9/1932 | Walters . | |
| 1,915,697 | 6/1933 | Robinson | 52/356 X |
| 2,055,442 | 9/1936 | Jones . | |
| 2,097,988 | 11/1937 | Ross et al. . | |
| 2,101,001 | 11/1937 | Balduf . | |
| 2,325,766 | 8/1943 | Gisondi . | |
| 2,642,968 | 6/1953 | Roush et al. | 52/356 X |
| 2,881,924 | 4/1959 | Kruse et al. . | |
| 3,127,145 | 3/1964 | McGinty et al. . | |
| 3,286,412 | 11/1966 | Greig et al. . | |
| 3,295,405 | 1/1967 | Burke . | |
| 3,300,924 | 1/1967 | Ashby et al. . | |
| 3,312,030 | 4/1967 | Gillespie . | |
| 3,460,302 | 8/1969 | Cooper . | |
| 3,461,638 | 8/1969 | Balinski | 52/238.1 |
| 3,482,369 | 12/1969 | Burke . | |
| 3,534,516 | 10/1970 | Cooper . | |
| 3,842,554 | 10/1974 | Swick . | |
| 3,948,011 | 4/1976 | Price et al. | 52/481 X |
| 4,128,979 | 12/1978 | Price | 52/241 |
| 4,194,333 | 3/1980 | Paton et al. . | |
| 4,245,448 | 1/1981 | Agar | 52/511 X |
| 4,394,808 | 7/1983 | Thorsell . | |
| 4,448,004 | 5/1984 | Thorsell | 52/241 |
| 4,566,241 | 1/1986 | Schneller . | |
| 4,693,047 | 9/1987 | Menchetti . | |
| 4,719,730 | 1/1988 | Winkowski . | |
| 4,765,111 | 8/1988 | Osawa | 52/509 X |
| 4,811,539 | 3/1989 | Menchetti . | |

FOREIGN PATENT DOCUMENTS

| | | |
|---|---|---|
| 1002279 | 12/1976 | Canada . |
| 1044870 | 12/1978 | Canada . |

OTHER PUBLICATIONS

PS 350 Movable Partition System brochure, Partition Systems (Mfg.) Ltd. (Edmonton and Calgary, Alberta, Canada) (date printed uncertain, but Applicant's copy bears a date stamp of the PTO Mail Room of Feb. 18, 1975).

PC 350 Gravity Lock Wall Systems product advertising sheets (3 pages.), Partition Components Inc., (Markhem, Ontario, Canada) Sep. 1987.

PC 350 Gravity Lock Wall Systems brochure, Partition Components, Inc. (Markham, Ontario, Canada) (printed in 1988?).

PC 350 Gravity Lock Wall Systems brochure, Partition Components, Inc. (Markham, Ontario, Canada) (printed in 1989?).

*Primary Examiner*—Richard E. Chilcot, Jr.
*Attorney, Agent, or Firm*—Vaden, Eickenroht, Thompson & Boulware

[57] ABSTRACT

A demountable wall system having studs and component parts capable of being used as a fully reinforced or edge grip system simply by turning the studs over. The studs are provided with cut-outs for receiving either the angled member of a suspension clip or receiving the ends of horizontal support members between a retaining member extending outwardly from the stud representing the cut-out portion of the stud and the surface of the stud. In both configurations, a gypsum board panel is supported by the suspension clip, which includes a gang nail plate which is driven into the panel, having the angled member thereof resting either directly in the cut-out of the stud or on a horizontal bar member which rests on the stud.

21 Claims, 2 Drawing Sheets

FIG 7
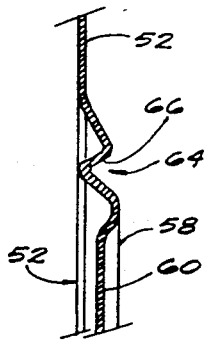
FIG 2
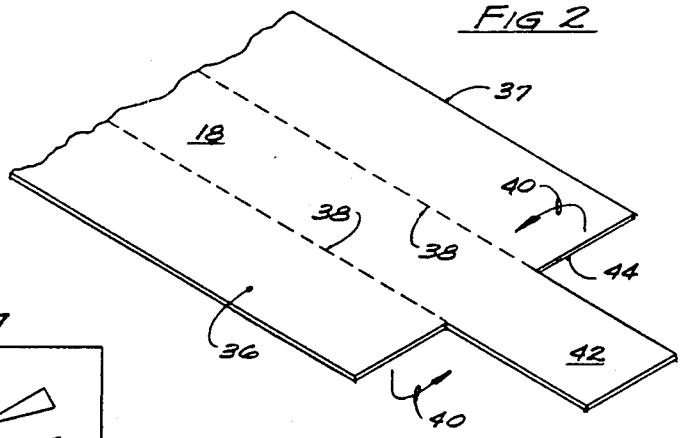
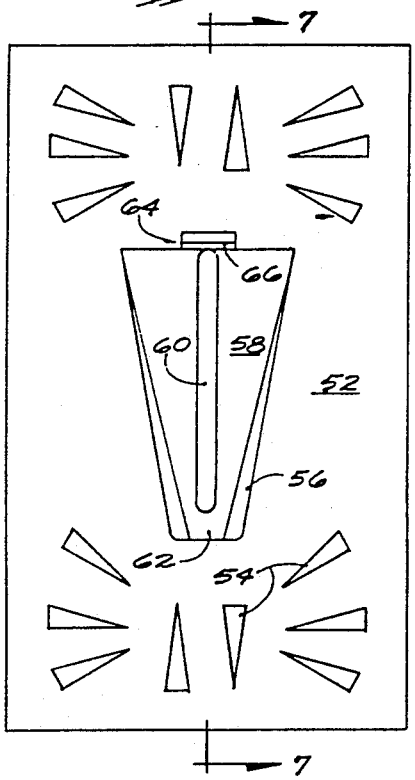
FIG 4
FIG 6
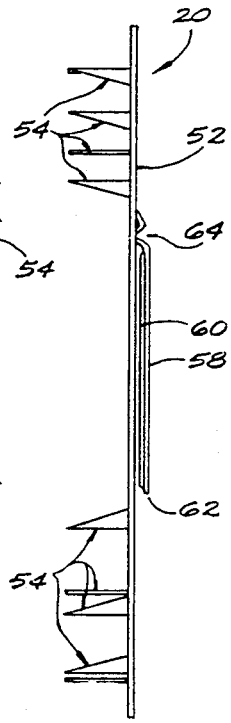
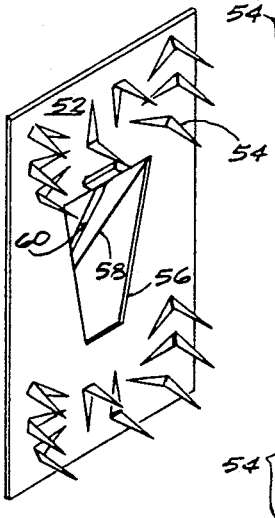
FIG 5

DEMOUNTABLE WALL SYSTEM

This application is a continuation of co-pending application Ser. No. 433,971, filed on Nov. 9, 1989, now abandoned.

BACKGROUND OF THE INVENTION

The present invention relates to the combination of multiple suspending gang nail plates on a gypsum board panel, the panel being mounted to a demountable partition wall utilizing a framework of vertical studs and horizontal bar members for suspending the panel to form a wall.

In recent years, removable partition walls have been widely used in buildings. In general, these walls involve mounting channel-like tracks on the floor and ceiling, installing vertical, channel-like metal studs in laterally spaced relationship between the runners, and securing gypsum board (sheetrock) panels to the studs. However, this technique is labor intensive because it requires that several operations be conducted on the joints between panels, e.g., they must be filled, taped and concealed with battens, to produce a neat, finished appearance.

A battenless system is described in U.S. Pat. No. 3,550,338, but the system described in that patent is characterized by a number of disadvantages and limitations, most importantly, that the metal strips used in the system must be of substantial length and width. This requirement arises from a shortcoming which is characteristic of gypsum board, namely that the bond between the board filling and the paper layer is frequently weaker in certain portion of tne panels than others. By providing long, wide strips, the system described in that patent ensures that at least portions of each strip will be attached to properly bonded material. Such strips are, however, relatively expensive, and thus contribute significantly to the cost of the system. Further, the strips, and the hooks and cut-outs of the system, must be precisely manufactured and positioned so that adjacent panels will be drawn into closely abutting relation. This precise manufacturing and assembly likewise adds to the cost of the system. Another limitation of this type of system is that considerable stress is placed on a relatively narrow portion of the stud due to the weight of the panels. This concentration of the weight leads to the sagging and weakening of the lateral stability of the wall. However, the wall usually is not reinforced to overcome this tendency because of the additional cost.

Another system is described in U.S. Pat. No. 3,948,011. That patent describes a system which includes gang nail plates which are said to be relatively inexpensive and easily attached to the back of a gypsum board panel for assembly into a wall system including horizontal channel members. Such a system is said in that patent to be competitive, price wise, with those systems on the market which use only vertical studs. This system is, however, likewise characterized by a number of disadvantages and limitations, as evidenced by the improvement patents, U.S. Pat. Nos. 4,128,979, 4,245,448, 4,394,808, 4,448,004, and 4,693,047 directed to various components of that same system that were ostensibly designed to solve the various problems encountered in erecting the system described in U.S. Pat. No. 3,948,011 (the "'011 patent").

Another limitation of the system described in that patent is not apparent from a description of the content of the specification of that patent. Specifically, that patent is, on information and belief, presently licensed exclusively to the National Gypsum Company's Gold Bond Building Products Division. Difficulties in dealing with the Gold Bond Building Products distribution system, and the fact that (in spite of the indication in the specification of the patent that the system is competitive, price-wise, with other systems on the market) the system has an installed price which is actually higher than the price at which permanently mounted dry wall can be installed, have provided the motivation for the present invention, the object of which is to provide a system which actually does have the cost and other advantages touted in the specification of the '011 patent for that system.

Another object of the present invention is to provide a demountable wall system in which the space between gypsum board panels is completely open to allow the flexibility of routing wires, cables, conduit or other utilities vertically within the wall cavity without obstructions, a significant advantage in a business or other environment in which computers, telephones, and other electronic equipment must be networked or linked together, an object which is not achievable with the system described in the '011 patent.

Another object of the present invention is to provide a demountable wall system which is assembled quickly and which requires minimal use of hand tools, using gravity and the weight of the components thereof to pull adjacent gypsum board panels into alignment with each other.

Another object of the present invention is to provide a demountable wall system which can be manufactured at low cost due to the minimal number of cuts and bends required to work the metal comprising each component of the system.

Another object of the present invention is to provide a demountable wall system having increased lateral stability over those wall systems which are currently available.

Still another object of the present invention is to provide a demountable wall system having the capability of supporting the gypsum board panels thereof from either the edges of the panels or from the center using a horizontal member and a suspension clip resting thereon.

Another object of the present invention is to provide a demountable wall system with improved fire code ratings.

Another object of the present invention is to provide a demountable wall system characterized by its flexibility of use. In other words, in certain instances, it is not necessary to support the gypsum board panel from behind to prevent flexing of the finished wall. For instance, at the end of a wall, there may be, for example, just an eight inch span between adjacent studs instead of the twenty-four (or whatever spacing is chosen) inch spacing between the centers of adjacent studs. In such instances, there is no need for the horizontal member extending between studs behind the panel. Nevertheless, the horizontal members must be used because there is no other way to support the gypsum board panel in the case of, for instance, the system described in the '011 patent. Further, not being a standard length, the horizontal members described in that patent must be cut to the desired length on the job site, adding to construction time and increasing wastage.

Other objects, and the advantages of the present invention, will be made clear by the following detailed description of one demountable wall system which is constructed in accordance with the present invention.

SUMMARY OF THE INVENTION

These objects, and the advantages of the present invention, are achieved by providing a demountable wall system comprising first and second channel-like track members mounted horizontally onto a ceiling and floor, respectively, in confronting relationship and a plurality of spaced, vertical I-shaped studs which extend from the floor to ceiling, the ends of which are received in the floor and ceiling track members. Each stud comprises a web and a chord having laterally extending flanges thereon, and the flanges are provided with a plurality of cut-outs at regularly spaced intervals along the length of the stud, each of the cut-outs having a retaining member representing the cut-out portion of the flange, extending at an angle from the base of the cut-out. A horizontal bar member rests in the angle formed by the retaining member and the inside surface of the flange of adjacent studs.

Also provided is a plurality of suspension clips, each of the clips having a cut-out therein, the cut-outs having an angled member representing the cut-out portion of the clip extending outwardly therefrom. The suspension clips are affixed to gypsum board panels, the angled member of the clips resting on the horizontal member so that the weight of the gypsum board panel both causes the panel to engage the horizontal member tightly and causes the horizontal member to engage the studs tightly, thereby ensuring close abutment and alignment of adjacent gypsum board panels to form smooth joints therebetween.

The suspension clip used to support the gypsum board panel also constitutes part of the present invention. That clip comprises a gang nail plate, preferably made of metal, for applying to the surface of a gypsum board panel and having a cut-out therein. An angled member, representing the cut-out portion of the cut-out in the gang nail plate, is bent outwardly from the gang nail plate, and the bend includes a stop formed therein for engaging the horizontal member over which the angled member extends when the gypsum board panel is supported by the gang nail plate on the horizontal member.

In another aspect, the present invention is characterized as a method of installing a wall comprising the steps of affixing a plurality of suspension clips having cut-outs therein to a gypsum board panel, the cut-out portion of each cut-out extending at an angle from the surface of the gypsum board panel, and erecting adjacent, vertically oriented studs, each of the studs being comprised of I-beams having a web and two chords with cut-outs spaced at regular intervals along the length of the chords, the cut-out portion of each cut-out forming a retaining member extending at an angle with respect to the surface of the chord in which the cut-out is located. The ends of a horizontal bar member are inserted into the angle formed by the retaining member and the surface of the chord in which the cut-out is located, and the angled member of the suspension clips affixed to the gypsum board panel is rested over the horizontal bar member to support the gypsum board panel and secure the connection between the horizontal bar member and the adjacent studs.

BRIEF DESCRIPTION OF THE DRAWINGS

FIG. 1 is an exploded, perspective view of two adjacent studs and their companion horizontal bar member in a demountable wall system constructed in accordance with the teachings of the present invention.

FIG. 2 is an enlarged, perspective view of the horizontal bar member of FIG. 1 before that member is folded, or bent, into the pleated cross-sectional configuration of the horizontal bar member of FIG. 1.

FIG. 4 is a plan view of a presently preferred embodiment of a suspension clip constructed in accordance with the teachings of the present invention and which is to be affixed to a gypsum board panel for resting on the horizontal bar member of FIG. 1.

FIG. 5 is a perspective view of the suspension clip of FIG. 4.

FIG. 6 is a side view of the suspension clip of FIG. 4.

FIG. 7 is an enlarged, sectional view of the suspension clip of FIG. 4 taken along the lines 7—7 in FIG. 4.

DETAILED DESCRIPTION OF THE PREFERRED EMBODIMENTS

Figures 3, 8:
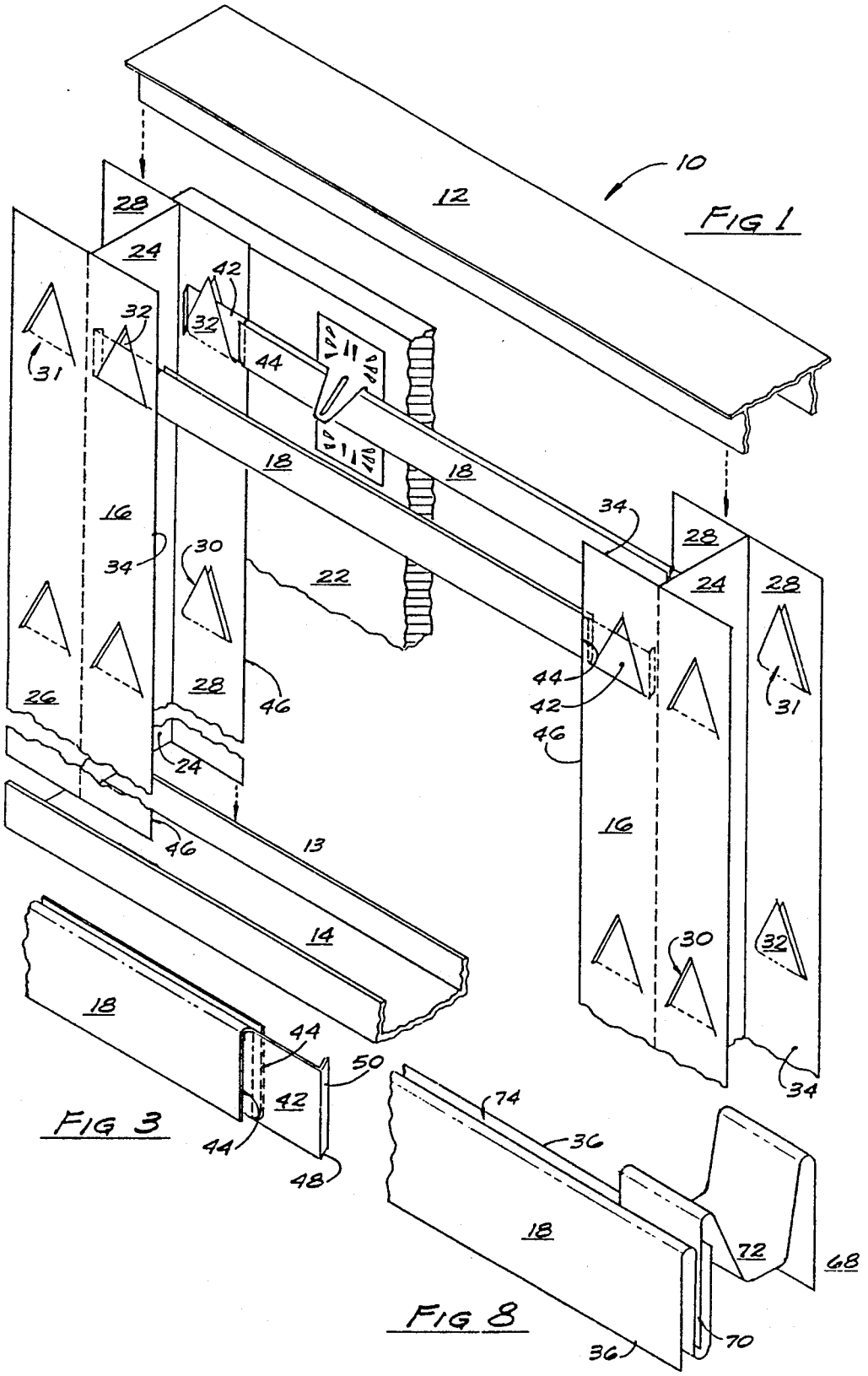
FIG. 3 is a perspective view of an alternative embodiment of the horizontal bar member of FIG. 2 after that member has been folded into a pleated configuration.
FIG. 8 is an enlarged, perspective view of the horizontal bar member of FIG. 1 showing the use of a spacer for preventing the flexing of the gypsum board panels (not shown).

Referring to FIG. 1, there is shown a perspective view of the various components comprising the demountable wall system 10 of the present invention. The system 10 is comprised generally of ceiling and floor track members 12 and 14, respectively, vertical I-beams, or studs, 16, horizontal bar members 18, suspension clips 20, and gypsum board panels 22. As shown in FIG. 1, the ceiling 12 and floor 14 track members are comprised of U-shaped track, or channel members, having the base 13 thereof adjacent the ceiling (not shown) and floor (also not shown) such that the open end of the "U" receives the respective ends of studs 16, e.g., ceiling 12 and floor 14 track members are assembled into system 10 in confronting relationship.

Studs 16 are oriented vertically with respect to ceiling 12 and floor 14 track members and are spaced apart from each other on, for instance, sixteen, twenty-four forty-eight inch centers as is known in the industry, or any other spacing as may be required or convenient. As will be explained below, the system of the present invention makes possible the use of forty-eight inch spacing in almost all applications, thereby resulting in significant cost savings in the time of installation and material costs.

The studs 16 are comprised of I-beams having a web 24 and chord 26, each chord being comprised of laterally-extending flanges 28. The flanges 28 are provided with a plurality of wedge-shaped cut-outs 30 longitudinally spaced at regular intervals along the length of each stud 16 for a purpose to be made clear below. The cut-outs 30 are formed by stamping with a die (not shown) which shears on two legs of the triangularly shaped wedge, but bends, rather than shears, along the third edge 31 (referred to herein as the "base" of the cut-out 30, but as will be described below, by the use of that term herein it is not intended to limit the bent leg of the cut-out 30 to the leg which is closest to the surface on which the studs 16 rest) such that each of the cut-outs 30 is provided with a retaining member 32 representing the cut-out portion of the wedge extending at an angle from the surface 34 of the flanges 28 from the base 31 of the cut-out 30.

Horizontal bar member 18 rests in the angle formed by the retaining member 32 and the inside surface 34 of the flanges 28 of adjacent studs 16. As will be explained, the horizontal bar members 18 support the gypsum board panels 22, and the weight of gypsum board panel 22, combined with the angle formed by the retaining member 32 and the inside surface 34 of the flanges 28, secures the joint between horizontal bar member 18 and stud 16. Further, the secure nature of that connection is accomplished without the use of tools to make the connection: all that is required is that the horizontal bar member 18 rest in the angle between retaining member 32 and inside surface 34 and that downward force be exerted on horizontal bar member 18 (e.g., gravity acting on the gypsum board panel 22). Securing this connection greatly facilitates the alignment of two adjacent gypsum board panels 22 in close abutment to form a smooth joint therebetween because the angle of retaining member 32 effectively acts as a camming surface, the action of which results in outward pressure on gypsum board panel 22.

Referring now to FIGS. 2 and 3, the horizontal bar member 18 of system 10 will be discussed in detail. As will be apparent to those skilled in the art who have the benefit of this disclosure, it is contemplated that horizontal member 18 be made of metal because FIG. 2 shows horizontal member 18 as a flat, elongate plate 36 which is folded, or bent, along the dotted lines 38 in the direction of arrows 40 to form the pleated horizontal bar member 18 shown in FIGS. 1, 3, and 8. Metal is the material of choice, however, because of applicable fire code regulations. Other materials can also be used if they are able to meet those standards. For instance, a rigid, non-flammable plastic could be extruded through a die in the pleated configuration shown in FIGS. 1 and 3 which would not require the subsequent folding in the directions of the arrows 40 shown in FIG. 2.

The ends of horizontal member 18 are provided with a tab 42, formed by shearing the corners of the flat plate 36 before folding, so that, when folded in the directions of arrows 40, the shorn edges 44 become integral shoulders formed in the ends of horizontal bar member 18. As shown in FIG. 1, the tabs 42 extending from each end of horizontal bar member 18 rest in the angle formed by the retaining member 32 and the inside surface 34 of the flanges 28 of each stud 16, and the shoulders formed by shorn edges 44 engage the edges 46 of the flanges 28 of studs 16 to form a means for increasing the lateral stability of the system 10. An alternative, or optionally additional, form which this lateral stability increasing means may take is that of a bent corner 48 on the end of tab 42 as shown in FIG. 3. Bent corner 48 provides a bearing surface 40 to abut the web 24 of stud 16 to maintain spacing between adjacent pairs of studs 16, thereby increasing lateral stability.

Suspension clip 20 is shown in detail in FIGS. 4–7, and is comprised of a gang nail plate 52 for applying to the surface of a gypsum board panel such as that shown at reference numeral 22 in FIG. 1. When driven into gypsum board panel 22, the nails 54 of gang nail plate 52 affix suspension clip 20 thereto. It will be understood by those skilled in the art who have the benefit of this disclosure that other materials could be supported besides sheetrock. The suspension clip 20 could be used, for instance, for supporting wooden paneling, plywood or other engineered lumber product, sound insulating material, baffles, and so on.

Gang nail plate 52 is provided with a cut-out 56 and an angled member 58 bent outwardly from the gang nail plate 52. Angled member 58 represents the cut-out portion of the gang nail plate 52, and for ease in shipping, manufacturing and handling, as well as affixing to a gypsum board panel 22, angled member 58 is only sheared from the legs, or sides, of the triangularly shaped cut-out 56 and pressed roughly parallel to gang nail plate 52 as shown in FIGS. 6 and 7. Because of the close spacing of angled member 58 from gang nail plate 52 (which is shown enlarged in the figures for purposes of clarity), it may be difficult to catch the edge 37 of one of the horizontal bar members 18 when it is desired to rest a gypsum board panel 22 to which the suspension clip 20 is affixed with the tip 62 of the angled member 58. Consequently, angled member 58 is provided with a groove 60 running along the longitudinal aspect thereof with the bottom of the groove oriented toward the side of gang nail plate 52 which contacts gypsum board panel 22. In that manner, the tip 62 of angled member 58 will always be forced outwardly from the surface of gypsum board panel 22 when suspension clip 20 is affixed thereto by driving the gang nails 54 into the gypsum board panel 22. Groove 60 serves the additional function of preventing bending along the longitudinal axis of angled member 60 except at bend 64.

Angled member 58 is bent outwardly from gang nail plate in a bend 64 including a stop 66 for engaging the edge 37 of a horizontal member 18 over which the angled member 58 rests when the gypsum board panel 22 to which suspension clip 20 is affixed is supported by the gang nail plate 52 on horizontal member 18. The bend 64 is shown in exaggerated proportion in FIGS. 6 and 7 because, as described above, the spacing between gang nail plate 52 and angled member 58 has been enlarged for purposes of clarity. In this manner, downward movement of the gypsum board panel 22 to which suspension clip 20 is affixed is limited by engagement of the edge 37 of horizontal member 18 and stop 66, allowing lateral movement of the gypsum board panel 22, even once it has been installed on the structural framework of studs 16 and horizontal members 18, to facilitate close abutment of adjacent gypsum board panels 22 to form smooth joints therebetween.

As noted above, one of the objects of the present invention is to provide a demountable wall system which is economical in materials, cost, and installation time. As should be apparent to those skilled the art who have the benefit of the preceding disclosure, one manner in which installation time is decreased in the case of the present invention is the elimination of the necessity of using several hand tools during erection of the system 10 (it is, expected, however, that installers will carry tools such as a rubber-headed mallet for tapping adjacent gypsum board panels 22 into alignment and other tools as are known in the art). Additional cost savings can be achieved by spacing the studs on forty-eight inch centers instead of twenty-four inch centers. The demountable wall system 10 of the present invention provides, for the first time insofar as is known, a system in which such spacing can be accomplished without compromising the strength and/or load-bearing properties of the wall.

The present invention also solves a problem which has been a significant obstacle to the marketing of known demountable wall systems, even those in which the studs are installed on twenty-four inch centers; namely, that of the "flexing" of the gypsum board panel. In other words, even though the load-bearing capabilities of the wall are well above the stated specifications, it has proven difficult, in spite of the many advantages, to convince the prospective purchaser to install such a wall system when the purchaser need only to push against the wall between two studs to feel the wall flex by perhaps as much as three quarters of an inch. The pleated configuration of horizontal bar members 18 helps to solve this flexing problem because of the rigidity imparted to the horizontal member 18 by the folding of plate 36 in the direction of arrows 40 as described above in connection with the description of FIG. 2. For particularly demanding installations, however, additional resistance to the flexing of the gypsum board panel can be obtained by the use of the spacer 68 shown in FIG. 8. The legs 70 on either end of the bridge 72 of spacer 68 are received within the channel 74 formed by the folding of plate 36 into the pleated configuration in horizontal members 18 mounted to both chords 26 of the adjacent studs 16. Confinement of the legs 70 of spacer 68 in channel 74 causes any force exerted against one gypsum board panel 22 to be transmitted to the horizontal bar member 18 and gypsum board panel 22 supported on the other chord 26 of stud 16, thereby providing additional resistance to flexing.

A further advantage of the present invention is the ability to utilize the components thereof in a so-called "edge grip" demountable wall system. Use of the wall system of the present invention in the edge grip configuration eliminates the need for the horizontal members altogether, but because of the flexing problem described above, use of the system 10 in that configuration is effectively limited to instances in which the spacing between studs 16 is under about twenty inches. Even so, there are enough instances in most normal finish-out jobs that the use of a system without horizontal members 18 has real cost advantages.

To use the system 10 of the present invention in an edge grip configuration, the studs 16 are simply turned over and the angled member 58 of the suspension clip 20 inserted directly into the cut-outs 30 in studs 16. In other words, studs 16 are positionable in both a first position in which the base 31 of each cut-out 30, which is substantially perpendicular to the long axis of the stud 16, is closest to the surface on which the stud rests, e.g., floor runner member 14, and a second position in which the base 31 of each cut-out 30 is furthest from the surface on which the stud 16 rests. The cut-outs 30 receive either:

tabs 42 on the ends of the horizontal bar members 18 extending between the adjacent studs 16 in the angle formed by retaining member 32 and the inside surface 34 of the flange 28 of chord 26, the angled member 58 of the suspension clips 20 affixed to gypsum board panel 22 resting on horizontal member 18 to support the gypsum board panel 22 and secure the connection between horizontal member 18 and studs 16 when the studs 16 are in the first position, or when the studs 16 are in the second position, the angled member 58 of the suspension clip 20 for supporting the gypsum board panel without using horizontal bar member 18.

As is clearly apparent from FIG. 4, the cut-out 56 and angled member 58 of each suspension clip are triangularly shaped to facilitate the receipt of the angled member 58 in the cut-out 30 of the studs 16 when studs 16 are in the second position.

Having described these preferred embodiments of a demountable wall system constructed in accordance with the present invention, it is important to note that this description is provided for the purpose of providing exemplification of the invention to comply with the requirements of the Patent Statute. Having complied with that requirement, it can be pointed out that, as will be recognized by those skilled in the art from this description, there are many changes that can be made to that preferred embodiment without departing from the spirit of the present invention. For instance, instead of constructing horizontal members 18 in pleated configuration, horizontal members can be constructed from a flat piece of metal and flex resistance provided by a spacer such as the spacer 68 having two closely spaced legs such as the legs 70 at both ends of bridge 72 to confine movement of the flat piece of metal comprising the horizontal member in both directions. Other examples of changes which could be made to the invention just by changing horizontal bar member 18 are many. For instance, the horizontal member could be tubular with spanked ends for resting in the angle formed by retaining member 32 and the surface 34 of the chord 26 of stud 16. In that instance, the angled member 58 of suspension clip 20 can either rest on top and over the tubular horrzontal member or be received (along with the legs 70 of spacer 68) within a longitudinal slot formed in the horizontal member. In the case of the flat horizontal member, a longitudinal groove may be stamped in the flat horizontal member to rigidify the member and a longitudinal slot provided in the curve of that groove for receiving the angled member 58 of the suspension clip 20. In short, changes such as these are intended to fall within the scope of the following claims.

What is claimed is:

1. A demountable wall system comprising:

first and second track members mounted horizontally on a ceiling and floor, respectively, in confronting relationship;

a plurality of spaced vertical studs extending between said first and second track members, each stud having laterally extending flanges thereon with a plurality of wedge-shaped cut-outs spaced at regular intervals spaced at regular intervals along the flanges, each of the cut-outs in the flanges having a retaining member representing the cut-out portion thereof extending at an angle from the base thereof;

a horizontal bar member resting in the angle formed by the retaining member and the inside surface of the flange of adjacent studs;

a plurality of suspension clips, each of said clips having a cut-out therein, and an angled member representing the cut-out portion member thereof extending outwardly therefrom; and a plurality of gypsum board panels having said suspension clips affixed thereto, the angled member of said suspension clips resting on said horizontal bar member whereby the weight of said gypsum board panel both causes said panel to tightly engage said horizontal bar member and said horizontal bar member to tightly engage said studs to align adjacent gypsum board panels in close abutment to form smooth joints therebetween.

2. The demountable wall system of claim 1 wherein said horizontal bar member is formed from an elongate member having a pleated cross-sectional configuration for resisting vertical movement when loaded and a tab extending from the ends thereof for resting in the angle formed by the retaining member and the inside surface of the flange of said studs.

3. The demountable wall system of claim 2 additionally comprising a spacer having legs thereon for resting in a channel formed by the pleated configuration of said horizontal bar member to prevent flexing of said horizontal bar member.

4. The demountable wall system of claim 2 wherein the ends of the tabs of said horizontal bar member are provided with bent corners to provide a bearing surface to maintain spacing between adjacent pairs of said studs to increase the lateral stability of the system.

5. The demountable wall system of claim 1 additionally comprising a second horizontal bar member, each of said horizontal bar members resting in the angle formed by the retaining member and the inside surfaces of the flanges of both chords of each of said studs for supporting gypsum board panels on both sides of said studs.

6. The demountable wall system of claim 5 additionally comprising means for spacing the horizontal bar members apart from each other to resist the flexing of the gypsum board panels mounted thereto.

7. The demountable wall system of claim 1 wherein the ends of said horizontal bar member are provided with shoulders to provide a bearing surface to maintain spacing between adjacent pairs of said studs to increase the lateral stability of the system.

8. The demountable wall system of claim 1 additionally comprising means for increasing the lateral stability of the system.

9. The demountable wall system of claim 1 wherein each of said suspension clips comprises a gang nail plate, the nails of which are driven into said gypsum board panels to affix said suspension clips thereto.

10. The demountable wall system of claim 1 wherein each of said suspension clips is provided with a stop for engaging said horizontal bar member when resting thereon.

11. A demountable wall system comprising:

a gypsum board panel;

a plurality of suspension clips affixed to said gypsum board panel, each of said suspension clips having a cut-out therein, the cut-out portion forming an angled member extending from the surface of said gypsum board panel;

a plurality of horizontal bar members; and a plurality of spaced, vertical studs, each of said studs being comprised of an I-beam having a web and two chords with triangularly shaped cut-outs spaced longitudinally along the chords, the cut-out portion of each of the cut-outs forming a retaining member extending at an angle from the base of the cut-out, said studs being positionable in a first position in which the base of each cut-out is substantially perpendicular to the vertical stud and closest to the surface on which the stud rests or a second position in which the base of each cut-out is substantially perpendicular to the vertical stud and furthest from the surface on which the stud rests, for receiving either the ends of one of said horizontal bar members extending between adjacent studs in the angle formed by the retaining member and the surface of the chord, the angled member of said suspension clips resting on the horizontal bar member to support said gypsum board panel and to secure the connection between said horizontal bar member and said studs when said studs are in said first position, or when said studs are in said second position, the angled member of said suspension clips for supporting said gypsum board panel without using said horizontal bar members.

12. The demountable wall system of claim 11 wherein the cut-out in each of said suspension clips is triangularly shaped to facilitate the receipt of the angled member of said suspension clips in the cut-out of said studs when said studs are in said second position.

13. A suspension clip for affixing to a gypsum board panel for demountably supporting the gypsum board panel on the horizontal support member comprising part of a demountable wall system comprising:

a gang nail plate for applying to the surface of a gypsum board panel;

a cut-out in said gang nail plate;

an angled member representing the cut-out portion of said gang nail plate bent outwardly from said gang nail plate; and a stop formed at the bend of said angled member for engaging the horizontal support member of a demountable wall system over which the angled member extends when the gypsum board panel is supported by said gang nail plate on the horizontal support member, the stop limiting downward movement of the gypsum board panel with respect to the horizontal support member as a result of the weight of the gypsum board panel.

14. The suspension clip of claim 13 wherein said angled member is provided with a longitudinal groove for raising said angled member off the surface of the gypsum board panel to which said gang nail plate is applied to facilitate the angling of the formed member outwardly from the surface thereof.

15. A method of installing a wall comprising the steps of:

affixing a plurality of suspension clips having cut-outs therein to a gypsum board panel, the cut-out portion of each cut-out extending at an angle from the surface of the gypsum board panel;

erecting adjacent, vertically oriented studs, each of the studs being comprised of I-beams having a web and two chords with cut-outs spaced at regular intervals along the length of the chords, the cut-out portion of each cut-out forming a retaining member extending at an angle with respect to the surface of the chord in which the cut-out is located;

inserting the ends of a horizontal bar member into the angle formed by the retaining member and the surface of the chord of the two adjacent studs; and resting the angled member of the suspension clips affixed to the gypsum board panel over the horizontal bar member to secure the connection between the horizontal bar member and the adjacent studs.

16. The method of claim 15 additionally comprising resisting lateral movement by engaging the web of the studs with the ends of the horizontal bar member.

17. The method of claim 15 additionally comprising limiting the downward movement of the gypsum board panel by engaging the top edge of the horizontal bar member with a stop formed in the portion of the clip at which the angled member is bent outwardly from the surface of the gypsum board panel.

18. A method of installing a wall comprising the steps of:

affixing a plurality of suspension clips having cut-outs therein to a gypsum board panel, the cut-out portion of each cut-out extending at an angle from the surface of the gypsum board panel;

erecting adjacent, vertically oriented studs, each of the studs being provided with laterally extending flanges having cut-outs spaced at regular intervals along the length of the flanges, each cut-out portion of the cut-out forming a retaining member extending at an angle with respect to the surface of the flange in which the cut-out is located;

inserting the ends of a horizontal bar member into the angle formed by the retaining member and the surface of the flange of the adjacent studs; and mounting a gypsum board panel to the erected studs by resting the angle members of the suspension clips affixed to the gypsum board panel over the horizontal bar member to wedge the horizontal bar member into the angle between the cut-out and flange of adjacent studs.

19. The method of claim 18 additionally comprising resisting lateral movement of the studs by engaging the studs with the ends of the horizontal bar member.

20. The method of claim 18 additionally comprising resisting the flexing to the gypsum board panel.

21. The method of claim 18 additionally comprising limiting the vertical movement of the gypsum board panel by limiting the downward movement of the suspension clip affixed to the gypsum board panel relative to the horizontal bar member.

* * * * *